US005991328A

United States Patent [19]

Choudhury et al.

[11] Patent Number: 5,991,328

[45] Date of Patent: Nov. 23, 1999

[54] CRUCIBLE FOR THE INDUCTIVE MELTING OR SUPERHEATING OF METALS, ALLOYS, OR OTHER ELECTRICALLY CONDUCTIVE MATERIALS

[75] Inventors: Alok Choudhury, Püttlingen; Matthias Blum, Büdingen; Harald Scholz, Rodenbach; Wilfried Goy, Kelsterbach, all of Germany

[73] Assignee: Ald Vacuum Technologies GmbH, Hanu, Germany

[21] Appl. No.: 08/898,169

[22] Filed: Jul. 22, 1997

[30] Foreign Application Priority Data

Jul. 23, 1996 [DE] Germany ..... 196 29 636

[51] Int. Cl.[6] ..... H05B 5/16

[52] U.S. Cl. ..... 373/156; 373/72; 373/158

[58] Field of Search ..... 373/151–158, 373/72

[56] References Cited

U.S. PATENT DOCUMENTS

| | | | |
|---|---|---|---|
| 3,223,519 | 12/1965 | Schippereit | 75/10 |
| 3,461,215 | 8/1969 | Reboux | 13/27 |
| 3,709,678 | 1/1973 | Helary et al. | 75/10 R |
| 4,432,092 | 2/1984 | Reboux | 373/157 |
| 4,660,212 | 4/1987 | Boen et al. | 373/156 |
| 5,109,389 | 4/1992 | Stenzel | 373/156 |
| 5,283,805 | 2/1994 | Kawano et al. | 373/156 |
| 5,299,224 | 3/1994 | Maubert | 373/71 |

FOREIGN PATENT DOCUMENTS

| | | |
|---|---|---|
| 0169765 | 1/1986 | European Pat. Off. . |
| 0276544 | 8/1988 | European Pat. Off. . |
| 0493276 | 12/1991 | European Pat. Off. . |
| 2548856 | 1/1985 | France . |
| 2036418 | 12/1990 | France . |
| 518499 | 1/1931 | Germany . |
| 3910777 | 10/1990 | Germany . |
| 4209964 | 9/1993 | Germany . |
| 4307317 | 1/1994 | Germany . |

OTHER PUBLICATIONS

Derwent Abstract in English of DE 4307317A.

Derwent Abstract in English of DE 4209964A.

Derwent Abstract in English of FR 2548856A.

*Primary Examiner*—Tu Ba Hoang

[57] ABSTRACT

A crucible (10) for the inductive melting or superheating of metals, alloys, or other electrically conductive materials is provided with palisades of approximately equal length, arranged vertically, parallel to, and a certain distance away from, each other around a circle so as to surround the melt. A plate-shaped or ring-shaped part (4) at the bottom ends of the palisades (3, 3', . . . ) holds the palisades (3, 3', . . . ). At least part of the palisades (3, 3', . . . ) are provided with cavities (5, 5', . . . ) or channels, through which a coolant flows. An induction coil (6), through which an alternating current flows surrounds the palisades (3, 3', . . . ) spaced from their outside surfaces. The palisades (3, 3', . . . ) have slots (**7*a*, 7*b*, 7*c*;, 7*a'*, 7*b'*, 7*c'*, . . . ), which extend vertically from the palisade-holding part (4) up to a point near the top edge. The inside wall (9, 9', 9", . . . ) formed by all the palisades together circumscribes a straight, regular prism with sides in the form of identical parallelograms and congruent top and bottom surfaces.

9 Claims, 7 Drawing Sheets

CRUCIBLE FOR THE INDUCTIVE MELTING OR SUPERHEATING OF METALS, ALLOYS, OR OTHER ELECTRICALLY CONDUCTIVE MATERIALS

BACKGROUND OF THE INVENTION

The invention pertains to a crucible for the inductive melting or super-heating of metals, alloys, or other electrically conductive materials with palisades, i.e., wall segments, of approximately equal length, which are arranged vertically, parallel to, and a certain distance away from each other around a circle so as to surround the melt; with a plate-shaped or ring-shaped part to hold the palisades, provided at the bottom ends of the palisades, at least parts of the palisades being provided with cavities or channels, through which a coolant flows; and with an induction coil through which an alternating current flows, and which surrounds the palisades a certain distance away from their outside surfaces.

A method for melting difficult-to-melt metals, especially tantalum, tungsten, and thorium as well as alloys of these metals in a water-cooled container (DE 518,499) is known, where the container consists of material, e.g., quartz glass, copper, or silver, with a melting point lower than that of the material to be melted, and where the energies required for melting and for cooling the container are supplied in such a way that the material is completely melted without being contaminated in any way by the material of the crucible. The crucible itself can be heated by means of an induction coil, and a current which rotates around the crucible is prevented by constructing the crucible out of individual segments, which are separated from each other by an insulating layer made of a material such as mica.

A high-frequency induction crucible is also known, which is made up of a plurality of palisades, all of which are arranged vertically on a circular base plate and which together form a hollow cylinder (U.S. Pat. No. 3,461,215). Cooling water flows through all of the current-conducting and heat-conducting palisades, which are surrounded by an induction coil. The base plate of ceramic material is provided with a sealed opening, through which the melt can be removed. Strips of insulating material are inserted between the palisades.

In addition, a crucible for the slagless melting of highly pure, reactive metals in a vacuum chamber is also known (EP 0 276 544), in which cooling water flows through the palisades, which are surrounded by the induction coil, and which are rigidly screwed to a circular, disk-shaped base plate. The tubular palisades are separated from each other by slots, whereas at the same time they are all connected electrically to each other by way of the base plate, which is made of metal.

The known crucibles suffer from the disadvantage of comparatively poor thermal efficiency. The attempt has therefore been made to add insulating material to the melt to reduce the loss of heat through the cooled palisades, but this leads in turn to contamination, although slight, of the melt (Schippereit, et al.). This contamination of the melt material, however, is undesirable in many modern applications, so that this method has been accepted to only a limited extent by industry.

The arrangement and design of the palisades themselves as well as their electrical connections to, or their insulation from, each other have also already been the object of numerous studies. U.S. Pat. No. 3,223,519, for example, describes crucible segments which are insulated from each other, whereas in the case of the crucible according to EP 0 276 544, the palisades are set up a certain distance away from each other but are connected to each other electrically.

A slotted crucible, finally, is also known (EP-A-0,169, 765), in which coolant flows through the individual palisades, which have a rectangular cross section. The individual palisades are uniformly distributed around a circle. Slots are provided between the palisades, and the interior space of the crucible consists of a regular, straight, polyhedral prism.

It is characteristic of the slotted crucible (cold-wall crucible) that, because of the high melting power/power density required and the associated forces, the bath forms a pronounced meniscus. Because of the effective principle on which the cold-wall crucible is based, it is necessary to slot the more-or-less cylindrical crucible. This slotting, however, causes severe disturbances in the magnetic field at the location of the slots, these disturbances leading to contractions or even to instabilities in the melt column. All the known designs must therefore be constructed expensively out of a large number of palisades with the goal of smoothing out the disturbances in the areas of the slots as much as possible.

The present invention is based on the task of creating a crucible of the type in question which does not need any insulating slag material and in which the amount of energy supplied to the melt can be adjusted to suit the material to be melted. In addition, the production costs are also to be reduced, and the formation of arcs prevented. Finally, this crucible is intended to make possible the formation of an especially stable melt column while excluding disturbances in the magnetic field.

SUMMARY OF THE INVENTION

According to the invention, this task is accomplished in that the palisades of the crucible have slots which extend vertically from the palisade-holding part up to a point close to the upper edge area, these slots extending radially inward from the external surface as far as the polyhedral inside wall of the crucible, the individual palisades being uniformly distributed around the palisade-holding part, a certain distance away from each other, the inside wall formed by all the palisades together forming a straight, regular prism with similar faces in the shape of parallelograms and with congruent top and bottom surfaces.

Additional features and details are characterized more thoroughly and described in the claims.

The invention can be embodied in a wide variety of ways; one of them is Illustrated in purely schematic fashion in the attached drawings:

DETAILED DESCRIPTION

Figure 1:
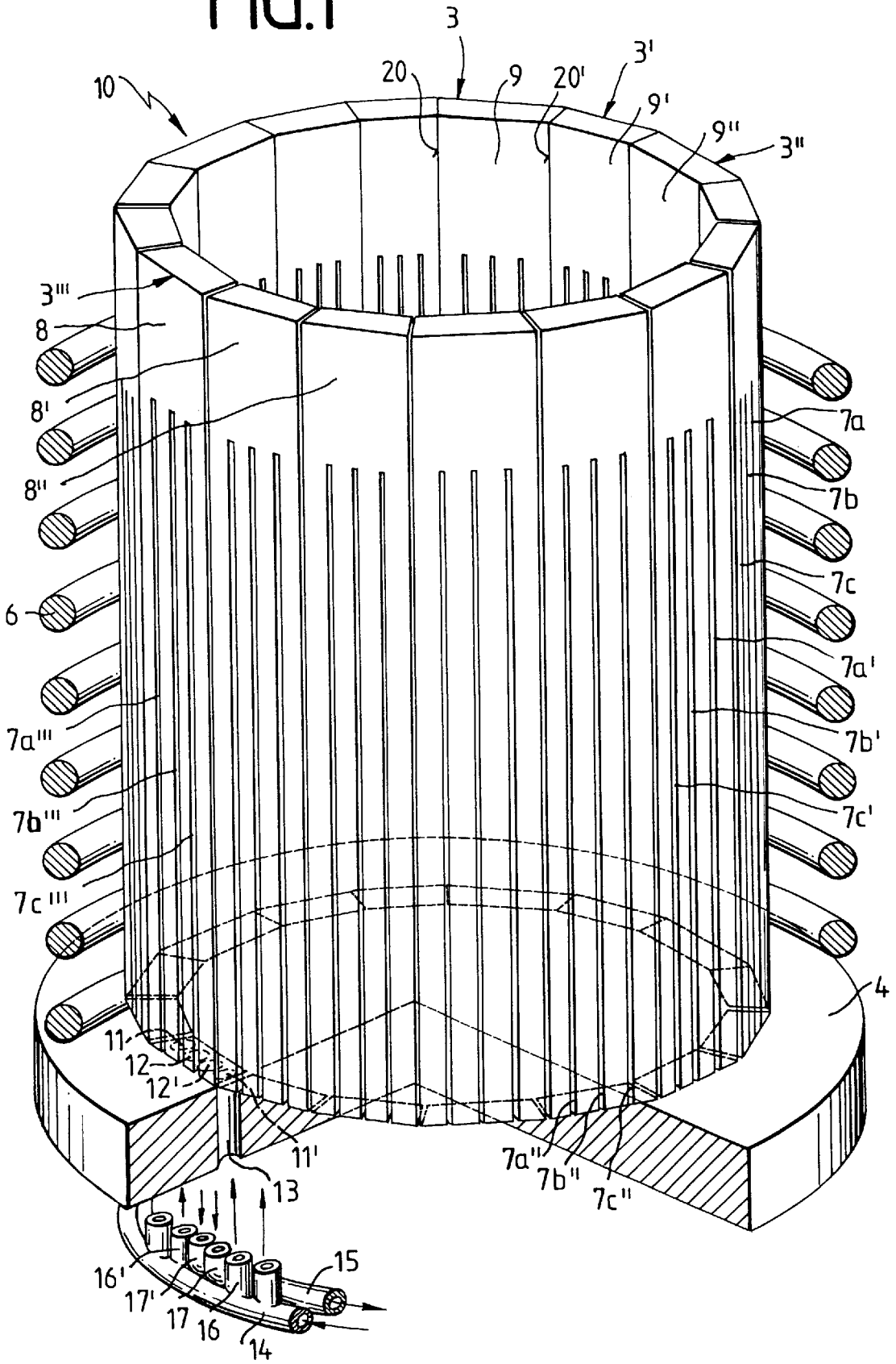
FIG. 1 shows a perspective view, in partial in cross section, of a slotted crucible with a polyhedral inside wall.
Figure 2:
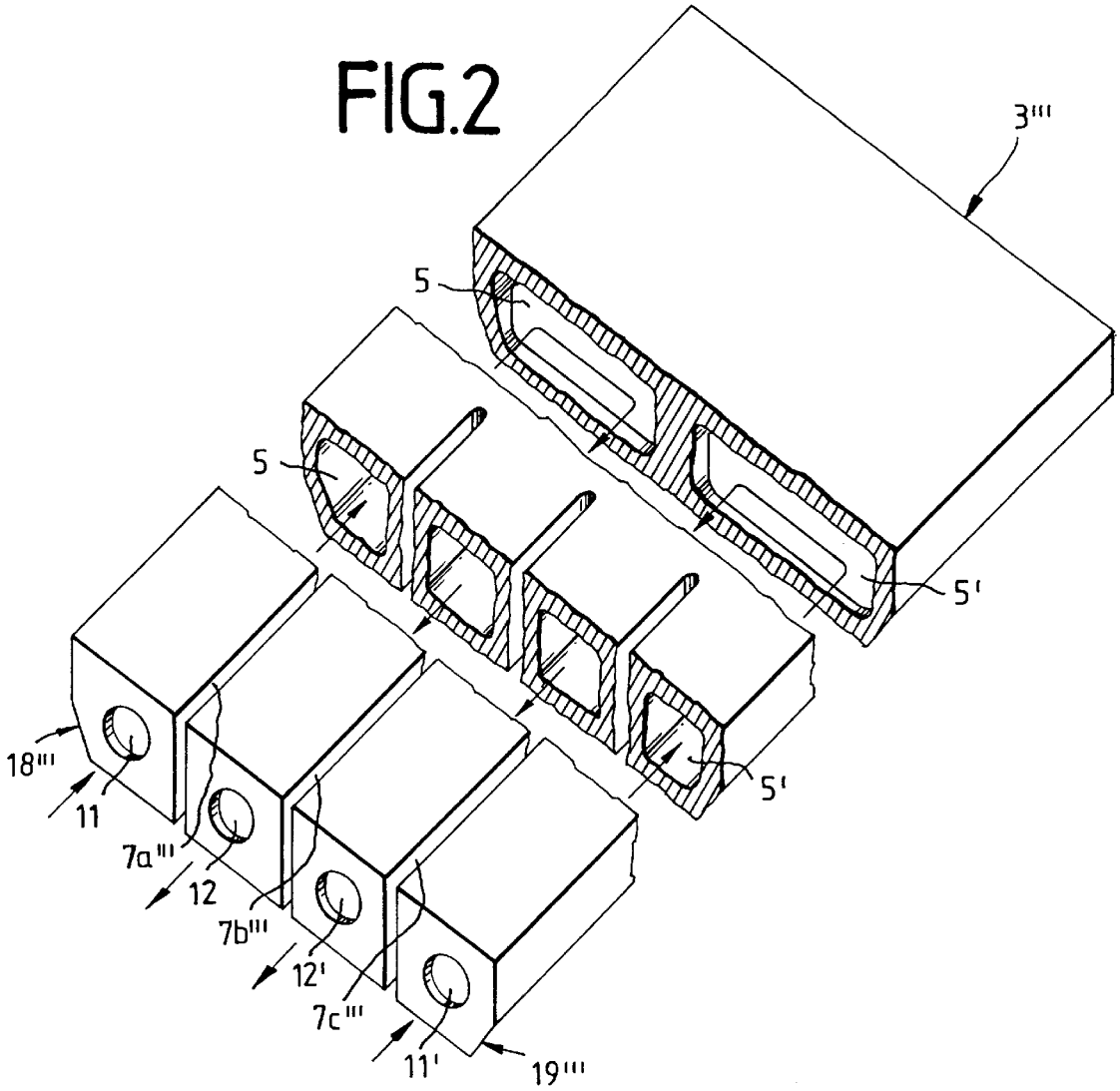
FIG. 2 shows a perspective view of a single palisade of the crucible according to FIG. 1, on an enlarged scale and broken into parts.

The crucible according to FIG. 1 consists of a total of sixteen palisades 3, 3', . . . , which are designed as hollow prisms and each of which is provided with channels 5, 5', . . . , in the longitudinal direction, so that the cooling water in the cavity of each palisade 3, 3', . . . can flow through these channels in the direction of the arrows. The crucible depicted in FIGS. 1–4 and described herein in further detail may also be in the format of a generally vase shape, a barrel shape, or a tapered down truncated pyramidal shape. The cavities or channels 5, 5', . . . in each palisade 3, 3', . . . match up either with a coolant inlet 11, 11', . . . or with a coolant return opening 12, 12', . . . , which correspond to matching bores 13, . . . in bottom part 4, which in turn are connected by way of pipe sockets 16, 16', . . . ; 17, 17', . . . to distribution lines 14, 15, respectively (only suggested in the drawing). As FIGS. 1 and 2 show, the cooling water in the case of palisade 3''', for example, flows from distribution line 14, via pipe sockets 16, 16' and bores 13, . . . in bottom part 4, through the two outer coolant inlet openings 11, 11', and into channels 5, 5'. Via coolant return openings 12, 12', the coolant then flows via corresponding bores in the bottom part and pipe sockets 17, 17' back into distribution line 15.

Each palisade 3, 3', . . . is provided with, for example, three slots 7*a*, 7*b*, 7*c*; 7*a'*, 7*b'*, 7*c'*, . . . , which extend from bottom part 4 almost as far as the top edge of palisades 3, 3', . . . . All the palisades together form a crucible 10, the inside wall of which forms a polyhedral prism. In the case illustrated by way of example in FIG. 1, there is a total of sixteen flat surfaces, which laterally enclose the melt in the crucible.

Figure 3:
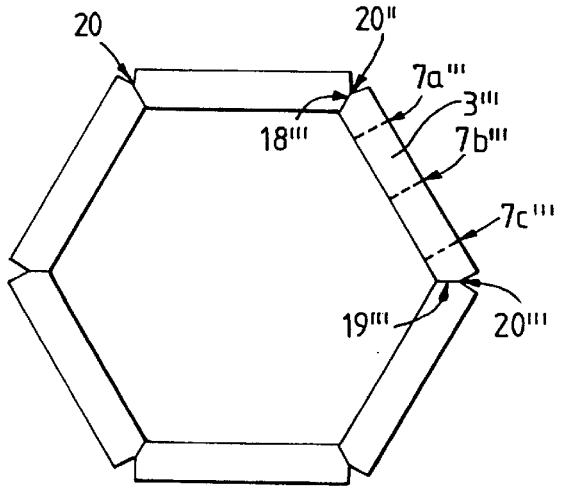
FIG. 3 shows a highly schematic diagram of a crucible consisting of a total of six palisades in view from above.
Figure 4:
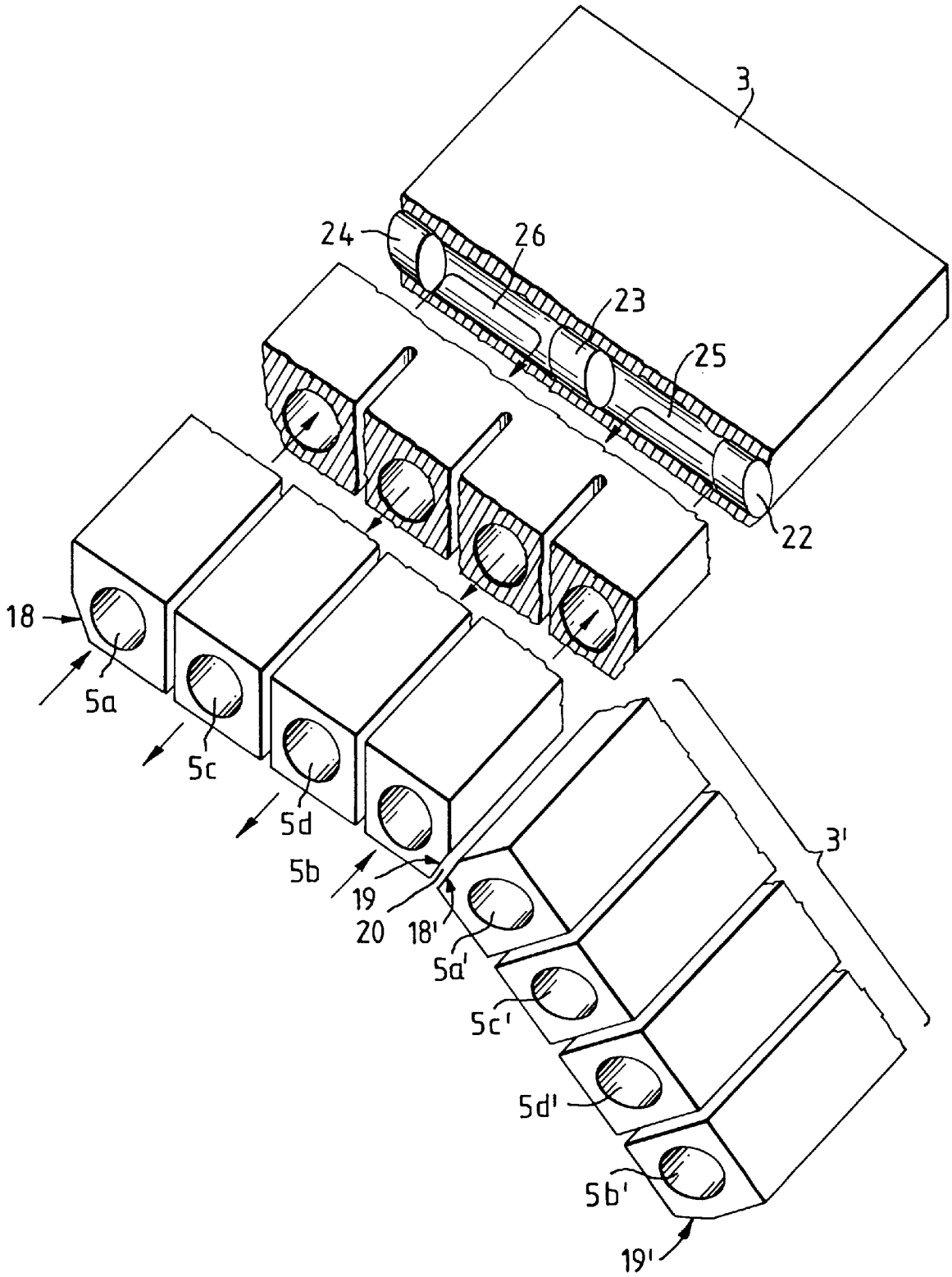
FIG. 4 shows a perspective view of two adjacent palisades, similar to those according to FIG. 2, broken into parts.
Figure 5:
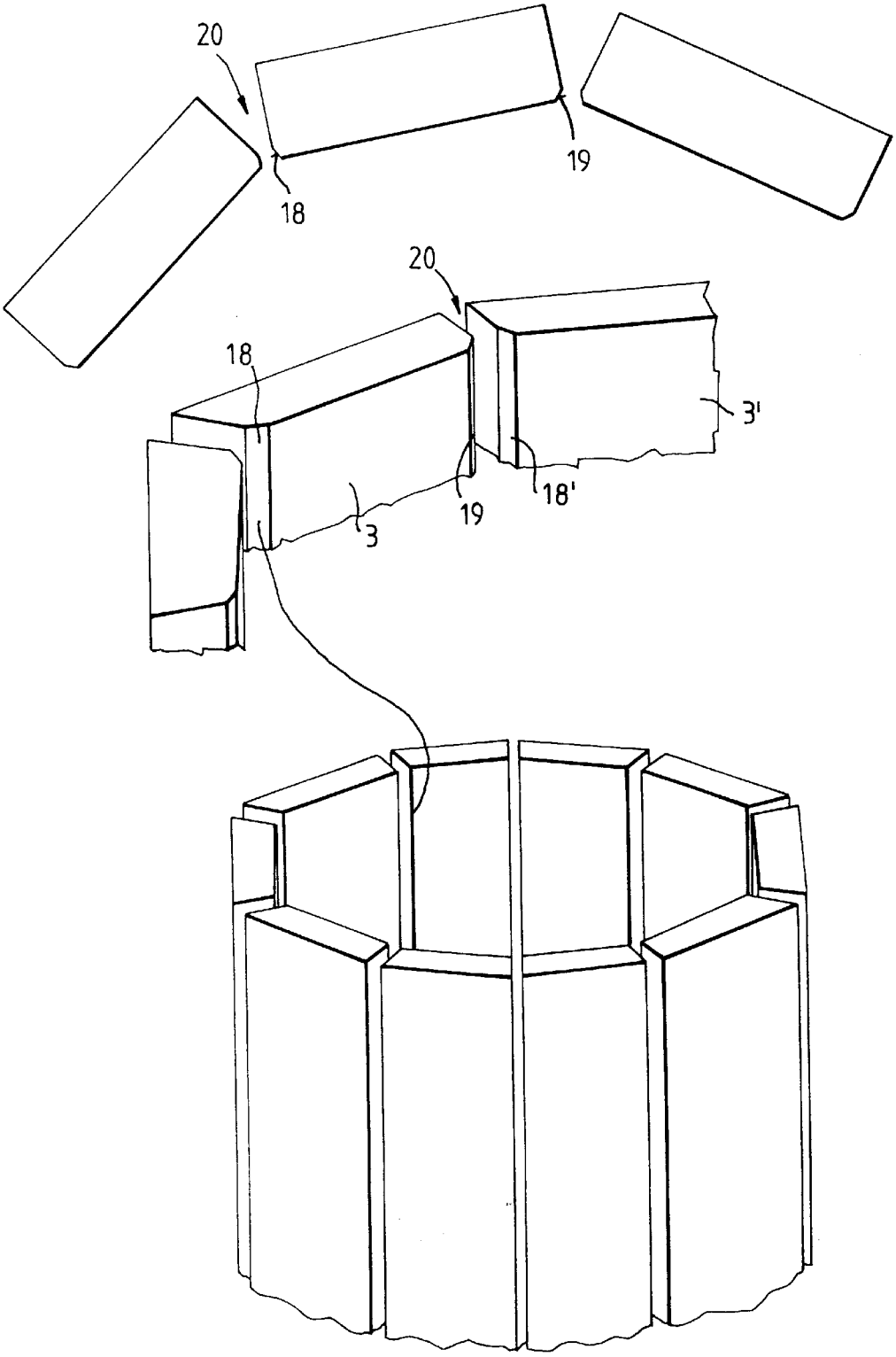
FIG. 5 shows a perspective view, in partial cross-section, of a slotted crucible with a polyhedral inside wall, wherein the polyhedral components of the wall are detailed.
Figure 6:
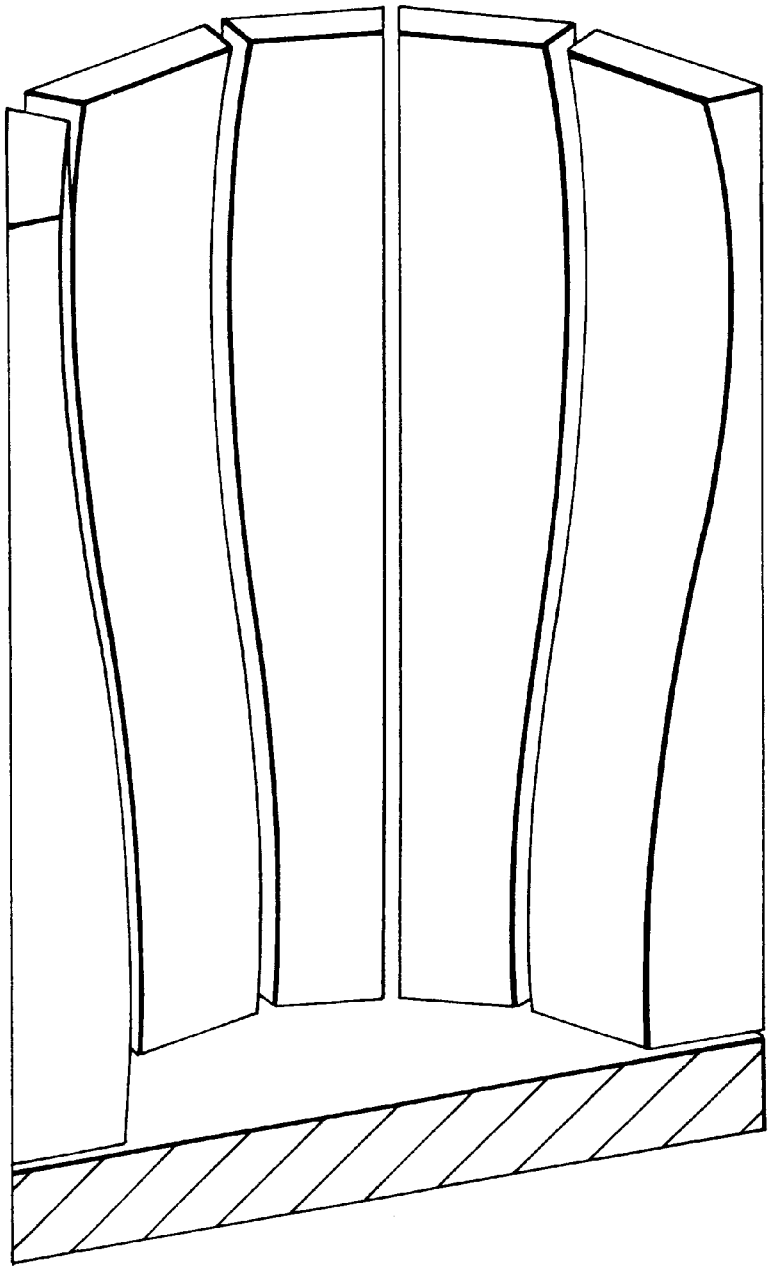
FIG. 6 shows a perspective view, in partial cross-section, of a vase-shaped crucible of the present invention.
Figure 7:
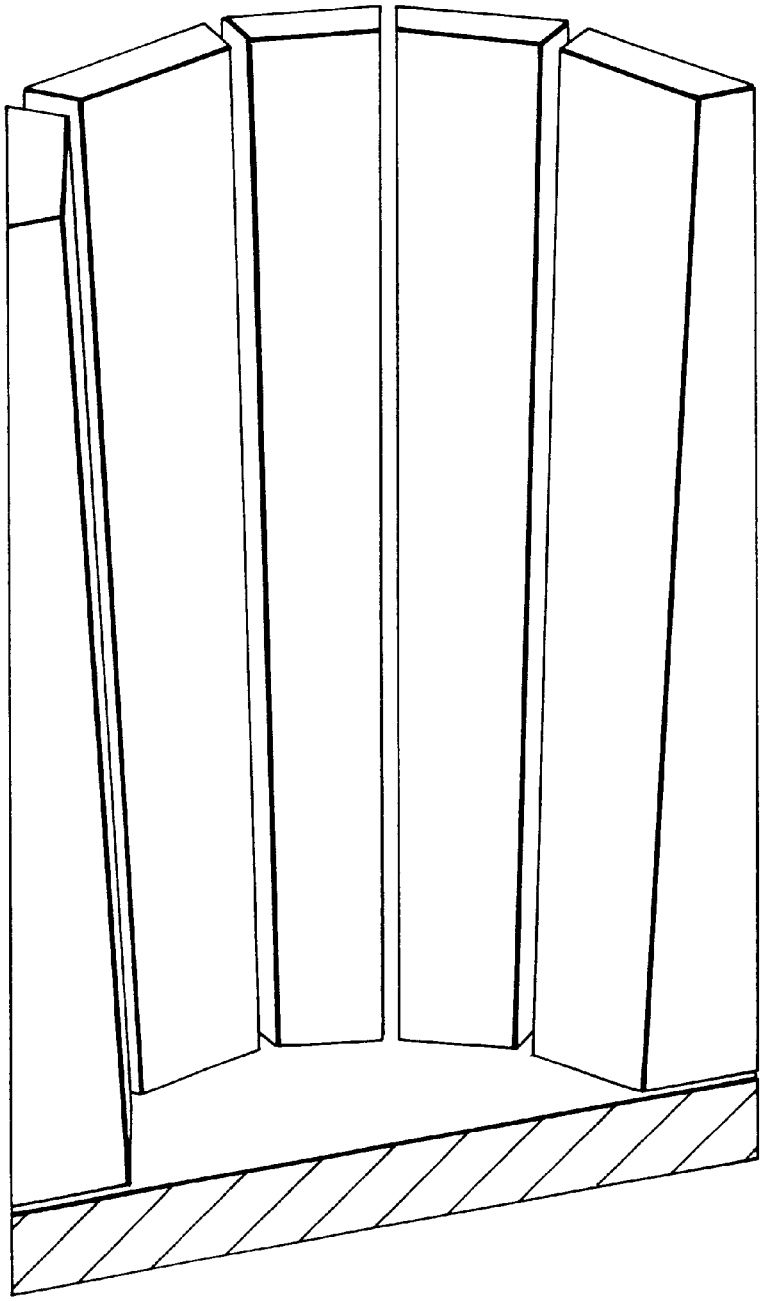
FIG. 7 shows a perspective view in partial cross section, of a tapered down truncated pyramid shaped slotted crucible of the present invention.
Figure 8:
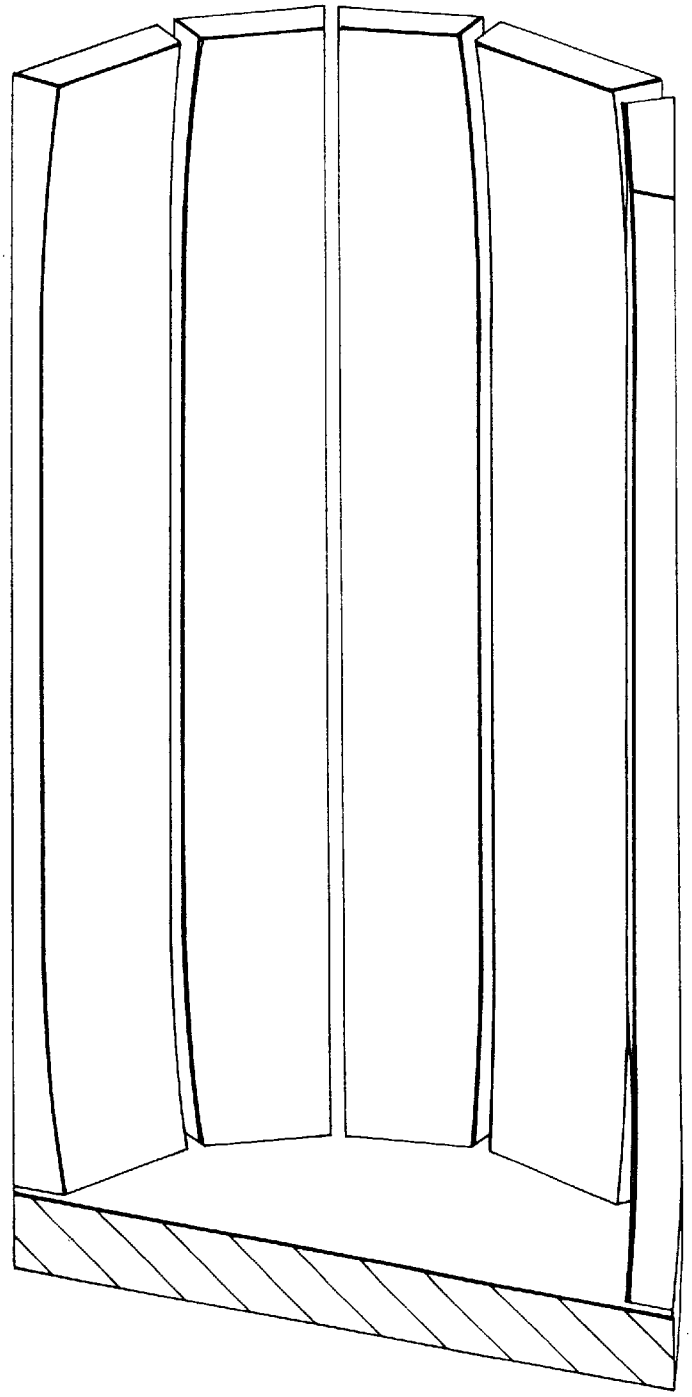
FIG. 8 shows a perspective view, in partial cross-section of a barrel shaped crucible of the present invention.

FIG. 3 shows a crucible from above; this crucible is assembled from a total of only six palisades 3, 3', . . . . It is advisable to provide the narrow, longitudinal sides of palisades 3, 3'. . . with bevels or chamfers (bevels or chamfers 18 and 19 may also be disposed on an interior surface as depicted in FIG. 5) 18, . . . ; 19, . . . , so that gaps 20, 20', . . . between two adjacent palisades 3, 3' . . . , can be configured so that the bevels of adjacent palisades 3, 3', . . . are parallel to each other in a certain area of each gap 20, 20'. . . . It is clear that the length of slots 7, 7*a*, 7*b*, . . . can also be different from each other as a way of limiting locally the action of induction coil 6 on the melt inside crucible 10.

In accordance with the task on which the invention is based, it is a particular goal to reduce the areas of disturbance between the palisades 3, 3' . . . ; this is accomplished in that the disturbance areas are shifted toward the side edges of the prismatic or polygonal interior space, with the result that they are now farther away from the melt column which forms. This has the result that, during the melting process, an especially uniform meniscus is formed, which shows little if any contraction.

The crucible described can be obtained in an especially simple and low-cost manner by fabricating the individual palisades 3, 3', . . . out of sheet metal and assembling them to form a polygonal crucible. In the embodiment according to FIG. 4, a blank consisting of a solid, thick-walled metal plate is provided with four longitudinal bores 5*a'*–5*d'*, which are then connected to each other by a transverse bore 21; transverse bore 21 is divided into sections with the help of plugs 22, 23, 24, soldered into transverse bore 21, which thus form two cavities or chambers 25, 26, into which bores 5*a*–5*d* open in pairs. The figure also shows, on an enlarged scale, a gap or slot 20', formed by two adjacent palisades 3, 3'. Crucible 10 can have a certain conicity, so that a skull can be pulled easily, when, for example, it is time to change to a different alloy. It is especially advantageous for this conicity not to be uniform over the entire height of the crucible.

To achieve a high degree of mechanical stability, the palisades are held on bottom part 4 by a metal ring (not shown in detail), which surrounds the bases of the palisades.

To realize an especially high degree of electromagnetic efficiency in the crucible, palisades 3, 3', . . . are slotted over part of their height. For the crucible design according to the invention, however, care must be taken to ensure that the electromagnetic efficiency of these additional slots 7, 7*a*, . . . is weaker than that of slots 20, 20', . . . , between the palisades 3, 3', . . . themselves. For these additional slots 7, 7*a*, . . . are closer in space to the melt meniscus and should not cause any local contraction.

The height and width of these additional slots 7*a*, 7*b*, 7*c*, . . . in the palisades 3, 3', . . . are smaller in comparison with palisades 20, 20', . . . so that the magnetic resistance is greater. As a result, the degree to which the magnetic field of induction coil 6 can penetrate directly into the melt is significantly reduced.

What is claimed is:

1. A crucible for the inductive melting or superheating of metals, alloys, or other electrically conductive materials, said crucible comprising:

a plurality of individual palisades of approximately equal length, arranged generally vertically, spaced apart from each other to form a slot between the adjacent sides each of said individual palisades and grouped generally in a circle so as to provide a polyhedral inside wall surrounding the melt, each of said palisades having an outwardly disposed outside surface;

a palisade holding part at the bottom ends of the palisades for holding the palisades;

at least part of the palisades being provided with cavities through which a coolant flows; and an induction coil, through which an alternating current flows and which surrounds the palisades spaced from the outside surface thereof;

the palisades having slots therein extending generally vertically from the palisade holding part up to a point near a top edge of the palisade, and extending from the outside surface to the polyhedral inside wall of the crucible, the individual palisades being distributed generally uniformly and spaced from each other around the palisade-holding part; and the polyhedral inside wall formed by all the palisades together circumscribing a straight, regular prism with sides in the form of substantially identical parallelograms having congruent top and bottom edges.

2. A crucible according to claim 1, wherein the palisades are each a metal blank piece in the form of parallelepipeds with longitudinal bores therein, each metal blank piece having elongated sides with bevels, each of said bevels, together with a respective bevel of an adjacent palisade, defining a longitudinal slot between said palisades.

3. A crucible according to claim 1, wherein slots between the individual palisades are wider than the slots in the individual palisades, wherein, for magnetic flux ($\phi$), approximately the relationship:

$$\phi_{slot\ between\ individual\ palisades} > \phi_{slot} > \phi_{slot\ in\ individual\ palisades}$$

is obtained, and wherein, for flux density (B) multiplied by the area (A) between the slot between individual palisades and palisade, B×A is obtained, where A is proportional to $r^2$ wherein r is the crucible diameter.

4. A crucible for the inductive melting or superheating of metals, alloys, or other electrically conductive materials, said crucible comprising:

a plurality of individual palisades of approximately equal length extending generally vertically and being spaced from each other by slots between the individual palisades formed by adjacent sides of the palisades, said palisades being grouped generally in a circle so as to provide a polyhedral inside wall surrounding the melt, each of said palisades having an outwardly disposed outside surface;

a palisade holding part at the bottom ends of the palisades for holding the palisades;

at least part of the palisades being provided with cavities through which a coolant flows; and an induction coil, through which an alternating current flows and which surrounds the palisades spaced from the outside surface thereof;

the palisades having slots therein extending generally vertically from the palisade holding part up to a point near a top edge of the palisade, and extending from the outside surface to the polyhedral inside wall of the crucible, the individual palisades being distributed generally uniformly and spaced from each other around the palisade holding part; and the polyhedral inside wall formed by all the palisades together circumscribing a space.

5. A crucible according to claim 4, wherein the slots between the individual palisades are wider than the slots in the individual palisades, wherein, for magnetic flux ($\phi$), approximately the relationship:

$$\phi_{slot\ between\ individual\ palisades} > \phi_{slot} > \phi_{slot\ in\ individual\ palisades}$$

is obtained, and wherein, for flux density (B) multiplied by the area (A) between the slot and palisade, B×A is obtained, where A is proportional to $r^2$ wherein r is the crucible diameter.

6. A crucible according to claim 4, wherein the palisades are formed as elongated, flat-surfaced bodies, each of which has a top end surface and a bottom end surface which are similar to each other but not congruent, and side surfaces each generally in the form of an elongated rectangle, and which form the boundaries of lateral surfaces in the form of trapezoids with substantially equal long sides, the palisades together enclosing a polygonal cross-section interior space in the form of a truncated pyramid.

7. A crucible according to claim 4, wherein the palisades are formed as pieces which taper down from a top thereof, and which together form an interior crucible space generally in the form of a truncated pyramid.

8. A crucible according to claim 4, wherein the palisades are formed as elongated, flat blanks which are wider toward the tops thereof and which together form a generally vase-shaped interior crucible space which expands in the upward direction.

9. A crucible according to claim 4 wherein the palisades are formed as essentially long, flat blanks, which taper down at both ends and which together form a generally barrel-shaped interior crucible space.

* * * * *